US010106922B2

(12) United States Patent
Papenfuss

(10) Patent No.: US 10,106,922 B2
(45) Date of Patent: Oct. 23, 2018

(54) KNITTING NEEDLE AND METHOD FOR PRODUCING A CIRCULAR KNITTING NEEDLE

(71) Applicant: William Prym GmbH & Co. KG, Stolberg (DE)

(72) Inventor: Andreas Papenfuss, Weimar (DE)

(73) Assignee: William Prym GmbH & Co. KG, Stolberg (DE)

( * ) Notice: Subject to any disclaimer, the term of this patent is extended or adjusted under 35 U.S.C. 154(b) by 0 days.

(21) Appl. No.: 15/747,155

(22) PCT Filed: Sep. 1, 2016

(86) PCT No.: PCT/EP2016/070601
§ 371 (c)(1),
(2) Date: Feb. 14, 2018

(87) PCT Pub. No.: WO2017/042084
PCT Pub. Date: Mar. 16, 2017

(65) Prior Publication Data

US 2018/0216265 A1 Aug. 2, 2018

(30) Foreign Application Priority Data

Sep. 10, 2015 (DE) ..... 10 2015 115 278

(51) Int. Cl.
*D04B 3/02* (2006.01)

(52) U.S. Cl.
CPC ..... *D04B 3/02* (2013.01)

(58) Field of Classification Search
CPC ... D04B 3/00; D04B 3/02; D04B 3/04; D04B 3/06; D04B 33/00
(Continued)

(56) References Cited

U.S. PATENT DOCUMENTS 1,327,918 A 1/1920 Kelsey
D54,688 S 3/1920 Schoettel et al.
(Continued)

FOREIGN PATENT DOCUMENTS

DE 1609910 U 7/1950
DE 625299 B 12/1951
(Continued)

OTHER PUBLICATIONS

Applicant disclosure at trade fair. Name of trade fair: h+h cologne. Location of trade fair: Cologne, Germany. Dates of trade fair: Mar. 18, 2016-Mar. 20, 2016. Picture of booth at trade fair is attached.
(Continued)

*Primary Examiner* — Danny Worrell
(74) *Attorney, Agent, or Firm* — Oppedahl Patent Law Firm LLC

(57) ABSTRACT

A knitting needle having at least one needle tip and a shank on which the knitting can be at least regionally arranged. A gripping region is arranged on the shank which can be gripped by a user during knitting. The knitting needle narrows along its length from the shank in the direction of the needle tip and is designed in a rounded manner and a droplet-shaped thickening, namely a retrieval droplet, is attached thereto, the latter having a smaller diameter than the shank. The transition between the shank and the narrowed portion and between the narrowed portion and the retrieval droplet is formed without edges and with little frictional resistance. Also included is a method for producing such a knitting needle. In said method, the knitting needle is designed as a circular knitting needle, wherein, during the production the cord is overmoulded with the material of the shank.

19 Claims, 6 Drawing Sheets

(58) Field of Classification Search
USPC ..... 66/117, 118, 1 R, 1 A
See application file for complete search history.

(56) References Cited

U.S. PATENT DOCUMENTS

| | | | | |
|---|---|---|---|---|
| D99,273 | S | 4/1936 | Ellis et al. | |
| 2,093,631 | A * | 9/1937 | Burnham | D04B 3/02 66/117 |
| 2,096,483 | A | 10/1937 | Cook et al. | |
| 2,133,431 | A | 10/1938 | Craft | |
| 2,230,495 | A | 2/1941 | Kohlmann | |
| 2,245,893 | A * | 6/1941 | Armitage | D04B 17/04 66/117 |
| 2,258,925 | A | 10/1941 | Burg et al. | |
| 2,271,477 | A | 1/1942 | Davis et al. | |
| D133,543 | S | 8/1942 | Megarry et al. | |
| 2,341,403 | A | 2/1944 | Williams et al. | |
| 2,440,413 | A * | 4/1948 | Mock | D04B 3/00 223/44 |
| 2,444,102 | A | 6/1948 | Kendig | |
| 2,456,718 | A | 12/1948 | Marinsky et al. | |
| 2,503,576 | A | 4/1950 | Baylin et al. | |
| 2,591,836 | A | 4/1952 | Landon | |
| 2,668,429 | A | 2/1954 | Barsky et al. | |
| 2,720,095 | A | 10/1955 | Ernst et al. | |
| 3,280,595 | A | 10/1966 | Linstead | |
| 4,047,397 | A * | 9/1977 | Laliberte | D04B 33/00 66/1 A |
| 4,195,496 | A | 4/1980 | Vasquez | |
| D269,734 | S | 7/1983 | Okada | |
| D271,062 | S | 10/1983 | Okada | |
| 4,501,133 | A * | 2/1985 | Kretzschmar | D04B 33/00 66/117 |
| 4,553,410 | A | 11/1985 | Okada | |
| 4,607,505 | A | 8/1986 | Dunker | |
| 4,646,543 | A | 3/1987 | Okada | |
| 4,693,094 | A | 9/1987 | Kahn | |
| D298,698 | S | 11/1988 | Okada | |
| D313,499 | S | 1/1991 | Pollock | |
| D362,539 | S | 9/1995 | Vigil | |
| 5,537,844 | A * | 7/1996 | MacLean | D04B 3/00 24/662 |
| D379,515 | S | 5/1997 | Kuehn | |
| D386,899 | S | 12/1997 | Carroll | |
| 5,720,187 | A | 2/1998 | Matuo | |
| D404,907 | S | 2/1999 | Vicente | |
| D413,431 | S | 9/1999 | Allender | |
| D434,216 | S | 11/2000 | Collingham | |
| 6,668,597 | B2 | 12/2003 | Robinson | |
| 6,983,627 | B1 | 1/2006 | Eley-Holden-Sotnik | |
| D526,477 | S | 8/2006 | Jost | |
| 7,114,354 | B1 | 10/2006 | Dremann | |
| 7,117,693 | B1 | 10/2006 | Nova | |
| D545,562 | S | 7/2007 | Feller | |
| D571,098 | S | 6/2008 | Jones | |
| D599,542 | S | 9/2009 | Hoffman | |
| D604,500 | S | 11/2009 | Buday | |
| D614,395 | S | 4/2010 | DeGrazia | |
| D615,747 | S | 5/2010 | Lindahl | |
| 7,874,181 | B1 | 1/2011 | Lindahl | |
| 7,874,182 | B1 * | 1/2011 | Lindahl | D04B 3/02 66/118 |
| D735,469 | S | 8/2015 | Rastogi | |
| D735,470 | S | 8/2015 | Rastogi | |
| D735,776 | S | 8/2015 | Rastogi | |
| D739,136 | S | 9/2015 | Rastogi | |
| D767,127 | S | 9/2016 | de Beer | |
| 9,493,893 | B2 * | 11/2016 | Selter | D04B 3/02 |
| D782,181 | S | 3/2017 | Rastogi | |
| 2003/0121291 | A1 | 7/2003 | Robinson | |
| 2010/0024488 | A1 | 2/2010 | Zeleny | |
| 2010/0218561 | A1 | 9/2010 | Devagnanam | |
| 2011/0197636 | A1 | 8/2011 | Selter | |
| 2012/0118021 | A1 | 5/2012 | Zheng | |
| 2012/0296465 | A1 | 11/2012 | Felice | |
| 2015/0143854 | A1 | 5/2015 | Defay | |
| 2015/0240398 | A1 | 8/2015 | Selter | |
| 2018/0023227 | A1 | 1/2018 | Mantione | |

FOREIGN PATENT DOCUMENTS

| | | | |
|---|---|---|---|
| DE | 1686720 | U | 11/1954 |
| JP | S5513965 | U | 1/1980 |
| JP | S62182986 | U | 11/1987 |
| KR | 850003106 | Y1 | 12/1985 |

OTHER PUBLICATIONS

Applicant distributed brochure at trade fair. Name of trade fair: h+h cologne. Location of trade fair: Cologne, Germany. Dates of trade fair: Mar. 18, 2016-Mar. 20, 2016. Brochure attached.

Applicant showed video at trade fair. Name of trade fair: h+h cologne. Location of trade fair: Cologne, Germany. Dates of trade fair: Mar. 18, 2016-Mar. 20, 2016. url of video shown at trade fair: https://www.youtube.com/watch?v=UFy1 PomtxMM&index=14 &list=PL3DDOFF876A8ECF3F.

Applicant created website for trade fair. Name of trade fair: h+h cologne. Location of trade fair: Cologne, Germany. Dates of trade fair: Mar. 18, 2016-Mar. 20, 2016. url of website: www.prym-ergonomics.com.

Applicant distributed samples to field workers at trade fair. Name of trade fair: h+h cologne. Location of trade fair: Cologne, Germany. Dates of trade fair: Mar. 18, 2016-Mar. 20, 2016.

Applicant sales. Dates of sales: Jan. 2017. Locations sales were made to: Germany, Switzerland, France, Denmark, Netherlands, Finland, Sweden, Italy, United Kingdom, Norway, Austria, Belgium, Luxemburg, Aland.

International Search Report in international application No. PCT/EP2016/070601 dated Oct. 28, 2016.

English Translation of the Written Opinion of the International Searching Authority in international application No. PCT/EP2016/070601, dated Oct. 28, 2016.

* cited by examiner

KNITTING NEEDLE AND METHOD FOR PRODUCING A CIRCULAR KNITTING NEEDLE

BACKGROUND OF THE INVENTION

The invention relates to an improved knitting needle and to a method for producing an inventive circular knitting needle.

Knitting needles have been known for a long time and are available in a large variety. Thus, DE 448 230 and U.S. Pat. No. 7,874,181 B1 each describe knitting needles which are designed to be noncircular in the region of the shank or of the gripping region and to have lobes and troughs to achieve an ergonomic design for the fingers even for longer knitting. However, the knitting process as such is not facilitated or influenced thereby.

DE 1 609 910 and DE 825 299 each describe a knitting needle which is intended to facilitate the knitting for a user, even if this person is somewhat clumsy. For this purpose, the needle tip has a deformation which completely or partially prevents thread return, for example, a narrowed portion, a one-sided thickening or also a two-sided to all-sided thickening. However, the disadvantage of this design of the needle tip is that the knitting yarn can become caught in the narrowed portion or behind the thickenings, so that further knitting using this specially shaped needle tip is difficult. In addition, in most needles, only one side is provided with a corresponding tip, while the other side has a normal knitting needle tip. Knitting with two needle tips which are correspondingly deformed is also difficult. Moreover, in the region of the needle tips, the knitting needles are designed to be very sharp, which can lead to injuries. In addition, there is the risk of sticking the needle into the yarn during knitting—particularly when using thicker yarn. If the user notices this, he or she has to pull the needle tip back again, which slows the knitting process. If the user does not notice this, this leads to an irregular stitch pattern, which should also be avoided.

U.S. Pat. No. 2,133,431 also describes a knitting needle, here a circular knitting needle, with deformations on the heads. The heads here are in the shape of a truncated cone with curved sides, wherein the radius of the truncated cone in the direction of the tip is greater than the radius of the truncated cone in the direction of the needle. This head should form a resistance for the stitches taken up on the needle, in order to enable firm knitting and prevent loose stitches. However, the disadvantage here is that the needle tips are designed to be very pointed, which can lead to injuries. Moreover, as already mentioned above, this can lead to sticking the needle through the yarn. An ergonomic and low-fatigue knitting is also not possible with these needles, and, in addition, the knitting person cannot produce loosely knitted knitwear, since the deformations on the needle tips represent a resistance and prevent this.

BRIEF SUMMARY OF THE INVENTION

Therefore, the aim of the invention is to improve a known knitting needle and thereby prevent the risk of injury and the risk of sticking the needle through the yarn and enable an ergonomic knitting with small amplitude in the movement of the wrist of the user. Another aim of the invention is to develop a cost-effective improved production method in order to produce an inventive circular knitting needle. These aims are achieved by the characterizing features of claims 1 and 12 which have the following special meaning.

The needle tip of the knitting needle is formed strongly rounded and has a thickening which is rounded towards the tip and which one can describe as droplet- or bobble-shaped, namely a retrieval droplet. Said retrieval droplet has a smaller diameter than the shank. Between the shank and the retrieval droplet, the knitting needle narrows. The transition between the shank and the narrowed portion and between the narrowed portion and the retrieval droplet is here formed without edges and with little frictional resistance. Due to the formation of the retrieval droplets and the narrowed portion with little frictional resistance and without edges, the knitting yarn can nevertheless slide well over the needle tip during the knitting process, and the retrieval droplet does not form an obstacle during knitting, so that the knitting yarn cannot catch. Due to the fact that the retrieval droplet has a smaller diameter than the shank, the needle is still sufficiently easy to handle to achieve good knitting results, even with a thin knitting yarn. Nevertheless, the retrieval droplet here helps to take up the next loop from the yarn during knitting. Due to the strongly rounded shape of the retrieval droplet, the risk of injury is also considerably decreased, as is the risk of sticking the needle tip of the knitting needle through the yarn during the knitting process. In this way, good knitting results can also be achieved with a thicker yarn. Due to the interaction between shank, gripping region and retrieval droplet, a particularly ergonomic and low-fatigue knitting is made possible, since the amplitude at which the wrist of the user has to perform during the knitting process is clearly smaller than with conventional knitting needles.

It is precisely the ratio of the diameter of the shank of the knitting needle to the diameter of the retrieval droplet which is mutually adjusted and dimensioned—adjusted to the thickness of the knitting needle—so that a very low-fatigue knitting process is possible. Here, the ratio of the diameters is approximately 25% to 75%, particularly 30% to 60%. Depending on the thickness of the knitting needle, the ratio can vary in order to enable the best possible ergonomic knitting process. Here, as a rule, the ratio of the diameters decreases with increasing thickness of the knitting needle, for example, from approximately 55% in the case of a needle thickness of 2.5, 3 or 3.5 to approximately 31% in the case of a needle thickness of 12. These are only a few explicit examples. The ratios of the diameters can also be different within the framework of the disclosure.

In a particularly preferred embodiment example, the shank has a shape transition along its length when viewed from the needle tip. This shape transition occurs behind the gripping region and has a cross section which is approximately in the shape of a triangle. The triangle region so formed ensures that very little friction is generated between the stitches of the knitting and the knitting needles, since the knitting touches the needle only in the region of the corners of the triangle. As a result, the knitting slides better onto the knitting needle, which makes the knitting process itself more ergonomic, so that the knitting person tires less quickly. It is precisely in the case of a broader knitting that said knitting does not always have to be pushed back on the knitting needle. The shape transition here also occurs without edges and with little frictional resistance. With regard to low frictional resistance and haptics, the best results are achieved if the triangle region has edges with a rounded cross section or sides formed convex. These two features can also be combined in order to produce a knitting needle in which the shape transition from the gripping region to the triangle region occurs very smoothly and with little frictional resistance, and wherein the triangle region is formed in such a manner that it does not damage the knitting yarn or the knitting and, in addition, has comfortable haptics.

The shank of the knitting needle as well as the needle tip and the retrieval droplet can consist at least regionally of a hard plastic. As a result, the knitting needle is light and lies well in the hand.

In a preferred embodiment example, the knitting needle is formed as a circular knitting needle. Circular knitting needles can here be used in a variety of applications for producing different knitted materials. A preferred embodiment of the circular knitting needle narrows behind the gripping region in the direction of the cord. This also results in reducing the frictional resistance between the knitting needle and the knitting, and the knitting can slide better in the direction of the cord.

It is particularly advantageous if the transition towards the cord in the end region of the shank is designed flexible and pliant. As a result, the knitting can slip particularly easily onto the cord, without the knitting person having to slide the knitting especially in this direction. In addition, the knitting cannot become caught on the transition towards the cord. Mechanical damaging of the cord is also prevented in this manner.

One possibility of designing the end region of the shank at the transition towards the cord in a flexible manner consists in producing this end region from a softer flexible plastic. This also results then in the pliant or flexible transition towards the cord. However, depending on the thickness of the needles, the material of the end region can also be produced with a wall thickness which is so small that the resilient properties of the material of the shank are exploited thereby, and a flexible and pliant transition is thus achieved in the end region towards the cord. In this case, the end region of the shank can consist of the same material as the entire knitting needle, for example, a hard plastic.

In another preferred embodiment example, it is provided that the knitting needle is formed as a cardigan knitting needle. On its end facing away from the needle tip, the cardigan knitting needle then comprises a spherical head. This spherical head prevents the shifting of the knitting past the end of the knitting needles and thus the loss of stitches. Moreover, the spherical head can also have a groove-shaped recess which has approximately the same diameter as the shaft or the gripping region of the knitting needle. The second knitting needle can then be introduced with its shank or its gripping region in a clamping manner into this recess. It is particularly preferable if, in this manner, the two knitting needles are clamped with their respective shank or their respective gripping region into the groove-shaped recess of the spherical head of the respective other knitting needles. In this way, the knitting needles can be stored well. Knitting which is located on one of the knitting needles cannot become separated therefrom, since most of the shank is limited by the two spherical heads. If the knitting needles are not in use, they can also each engage in the groove-shaped recess of the spherical head of the other needle, so that the two knitting needles can always be found together, when they are needed. The spherical head can be shaped differently here, for example, as a sphere, a prism, a cube, a cuboid, a cone, a pyramid, etc. Here, all possible shapes are conceivable.

Moreover, the invention comprises a method for producing a circular knitting needle. In order to connect the shank to the cord, the cord is overmolded here with the shank material. The material of the shank is preferably a plastic which can be processed by a conventional injection molding method. If, in the case of the circular knitting needle, a region should consist of a hard plastic and a region should consist of a soft plastic, then it is reasonable to at least regionally overmold the cord first with the harder plastic of the shank and then with the soft plastic. Thereby, a secure retaining of the cord in the plastic can be achieved. It is particularly preferable here to form an outer contour from the harder material, in particular, a fir tree pattern. The overmolding of this fir tree pattern or another contour with the soft plastic results in a particularly good cohesion between the two different plastics.

In order to achieve a secure overmolding of the cord, it is advantageous to retain the cord by means of one or more, in particular three retaining cores during the injection process. If only one material is provided for the shank, then the retaining cores are pulled back during the injection process, so that a smooth surface without perforations is formed in the end region. In the two-step injection process, during the first process step, the retaining cores can retain the cord and be pulled back only thereafter. If the cord is then overmolded with the soft component, the openings which formed due to the retaining cores are covered by the soft plastic.

Additional advantages and embodiment examples result from the following descriptions, the dependent claims and the drawings.

BRIEF DESCRIPTION OF THE SEVERAL VIEWS OF THE DRAWINGS

In the figures, the invention is represented in several embodiment examples. In the drawings.

DETAILED DESCRIPTION OF THE INVENTION

Figure 1:
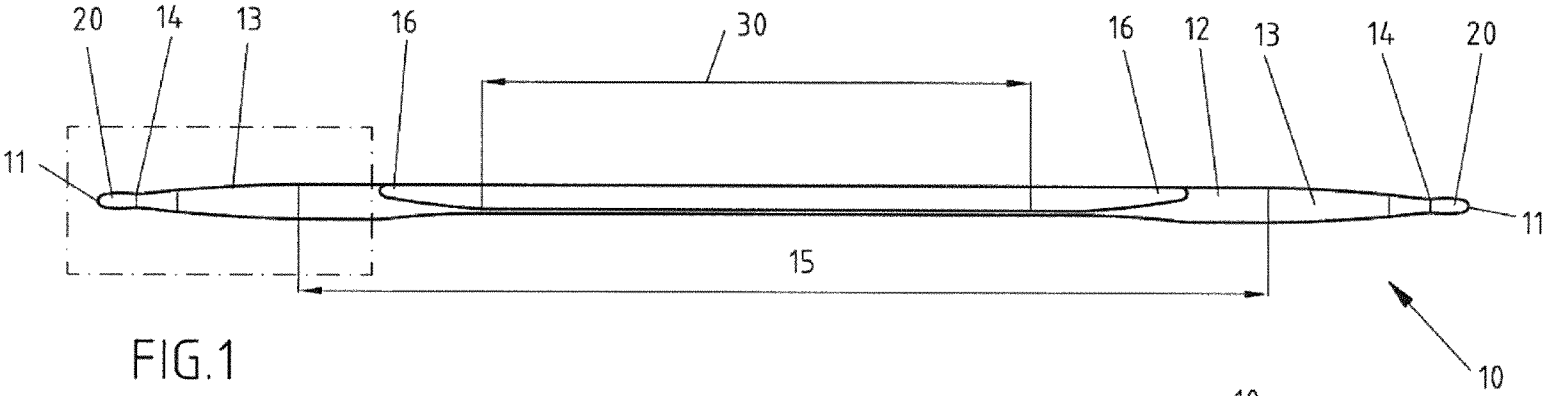
FIG. 1: shows an embodiment of the inventive knitting needle as a sock knitting needle.

In FIG. 1, an inventive knitting needle 10 can be seen, which is designed here as a sock knitting needle. Said knitting needle has a symmetric design and has two needle tips 11. On the needle tips 11, in each case a strongly rounded reversal drop 20 is attached, and the needle tips 11 are connected to one another by means of the shank 12. In the region of the shank 12, which faces the respective needle tip 11, in each case a gripping region 13 is provided, which can be gripped by a user during knitting. A narrowed portion 14 is provided in each case between the respective gripping region 13 and the reversal drop 20. The transition between the reversal drop 20 of the narrowed portion 14 and the gripping region 13 is designed here to be very streamlined and has a low frictional resistance.

Moreover, one can also see the triangle region 30, wherein a shape transition 16 occurs between the gripping region 13 and the triangle region 30. This shape transition is also formed in such a manner that the knitting can slide more simply on the knitting needle, and the knitting person does not always have to manually push the knitting farther back. As a result, the knitting becomes more comfortable and more rapid.

Figure 2:
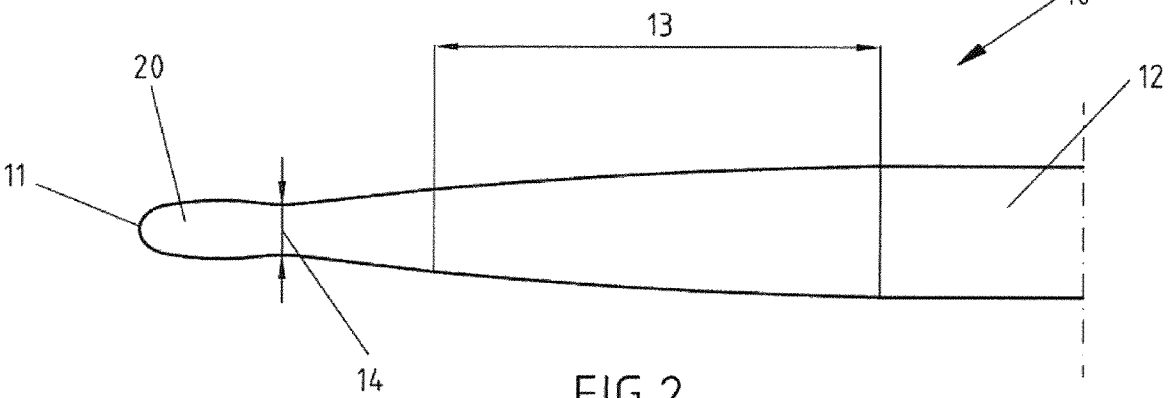
FIG. 2: shows an enlarged detail from FIG. 1, FIG. 3: shows an embodiment of the inventive knitting needle as a circular knitting needle.

FIG. 2 shows an enlargement of the needle tip 11. Here, one can see the droplet- or bobble-shaped reversal drop 20 which is strongly rounded towards the tip, as well as the narrowed portion 14. One also notices the smooth transition between retrieval droplet 20 and gripping region 13 of the shank 12, on which no edges are provided, and which has a low frictional resistance, so that the stitches can slide well over the knitting needles. The retrieval droplet 20 is intended here to help the user grip the yarn more simply, in order to produce a new stitch. The retrieval droplet 20, the shank 12 and the gripping region 13 are here adjusted to one another in such a manner that a particularly ergonomic and low-fatigue knitting becomes possible for the user.

The gripping region 13 is formed slightly conical, in order to achieve comfortable haptics, when it is gripped by a user. In addition, there are no edges of any type between the gripping region 13 and the rest of the shank 12, and the transition is here also designed in such a manner that the knitting needle 10 overall has a low frictional resistance and can be gripped well by the user.

Figure 3:
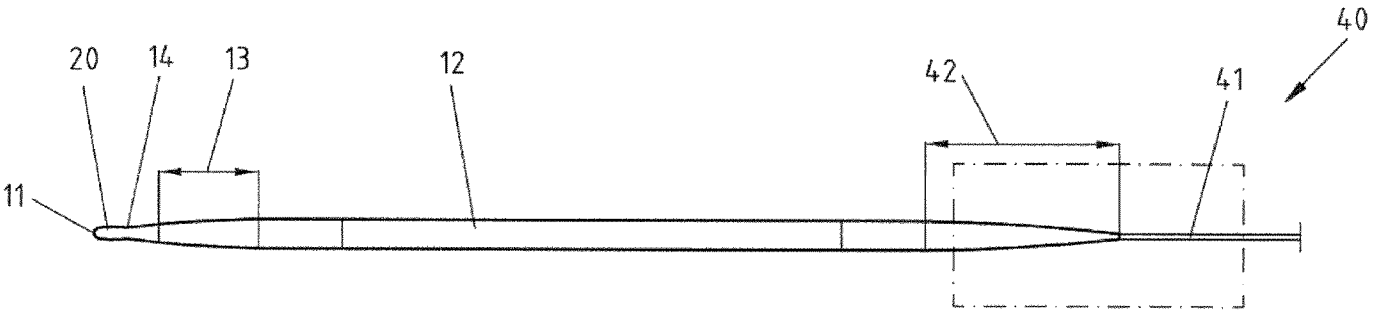
Figure 4:
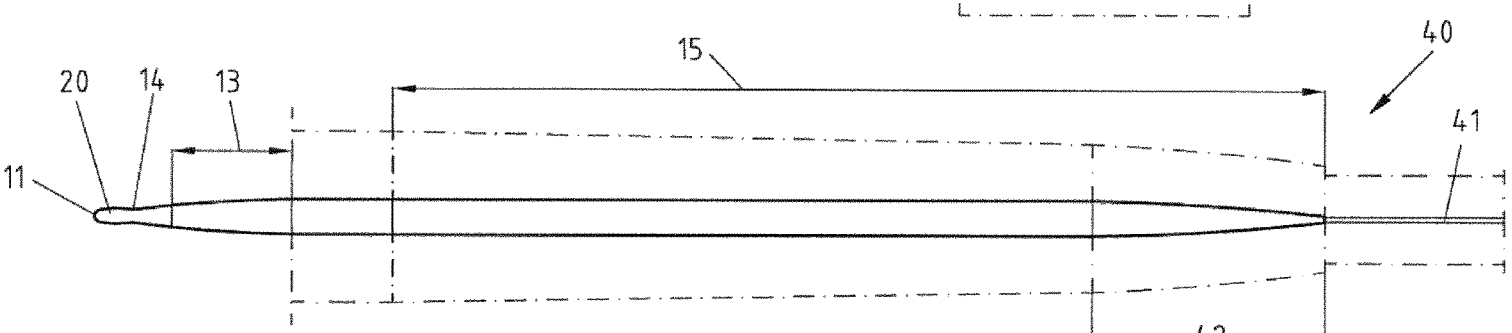
FIG. 4: shows the circular knitting needle from FIG. 3 in an enlarged representation.
Figure 5:
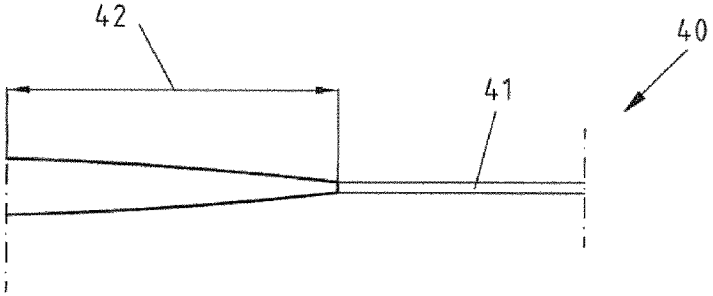
FIG. 5: shows the end region of the circular knitting needle from FIGS. 3 and 4, FIG. 6: shows a diagrammatic representation of the attachment of the cord in the end region of the circular knitting needle according to FIGS. 3 to 5, FIG. 7*a*: shows a representation of the retention of the cord by retaining cores before the injection process for producing a circular knitting needle according to FIGS. 3 to 6, FIG. 7*b*: shows a representation according to FIG. 7*a* after the injection process.

In FIGS. 3 and 4, the knitting needle 10 is formed as a circular knitting needle 40. Here too, one can again see the retrieval droplet 20 on the needle tip 11. In addition, the narrowed portion 14 between gripping region 13 and needle tip 11 can be seen. The two shanks 12 of the circular knitting needle 40 are connected via a cord 41. Here, only one needle or one shank 12 is represented.

The circular knitting needle 40 represented in particular here is a knitting needle 10 of very small thickness. Consequently, there is also no shape transition 16 and thus also no triangle region 30. From the dot-dashed line representation in FIG. 4, which substantially represents the outer contours of the shank 12 including the end region 42 and the cord 41 in an enlargement, one can see that the entire shank 12 becomes smaller in the direction of the cord 41. As a result, this circular knitting needle 40 also has a low frictional resistance, which is otherwise achieved with a triangle region 30. The production of such thin circular knitting needles 40 is thus also cost-effective, while introducing a triangle region 30 in the case of such thin needles is more difficult and possibly more expensive.

Figure 6:
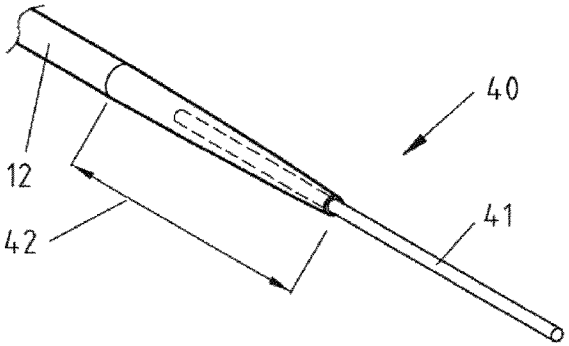

The cord 41 is introduced into the end region 42 of the circular knitting needle 40, wherein the circular knitting needle 40 is here produced from a hard plastic material. Here, the cord 41 has been overmolded with this material during the production process, as will also be shown later. Due to the small wall thickness, the end region 42 of the circular knitting needle 40 is formed to be flexible and resilient, although it is made of the same hard plastic material as the rest of the shank 12. FIG. 6 shows how the cord 41 is introduced into the end region 42 of the shank 12, wherein the portion of the cord 41 which is located in the end region 42 is indicated here with dashed lines.

Figure 7B:
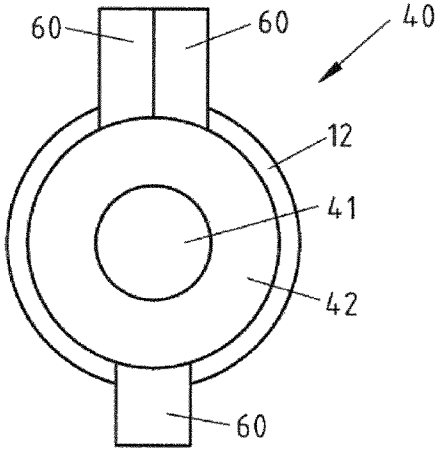
Figure 7A:
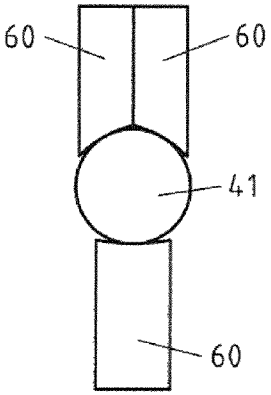

FIGS. 7*a* and 7*b* show parts of the production process of the circular knitting needle 40 represented in FIGS. 3 to 6. In FIG. 7*a*, the cord 41 is positioned by means of three retaining cores 60. Thereafter, the plastic injection molding process occurs, in which the cord 41 is overmolded with the material of the end region 42, here a hard plastic. After the injection process, the retaining cores 60 are flush with the surface of the end region 42. As a result, no perforations in the end region 42 of the circular knitting needle 40 can be seen, and an appealing overall visual appearance is shown.

Figure 8:
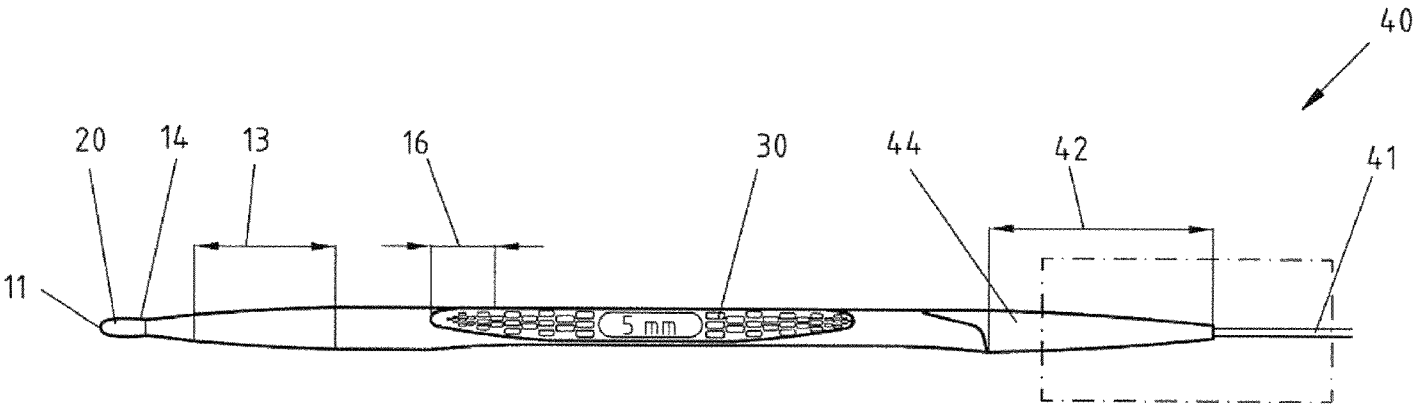
FIG. 8: shows an additional embodiment of an inventive circular knitting needle.

FIG. 8 shows an alternative of a circular knitting needle 40. This circular knitting needle 40 has a greater thickness than the one shown in FIGS. 3 to 7*b*. Here, the thickness is 5 mm. Naturally, this should only be considered as an example. The invention comprises circular knitting needles 40 of a great variety of diameters and thicknesses.

Here too, a reversal drop 20 is again provided on the needle tip 11, wherein there is a narrowed portion 14 towards the gripping region 13 of the shank 12. However, this circular knitting needle 40 comprises a shape transition 16 towards a triangle region 30. This again results in the already mentioned advantages of the low frictional resistance of the circular knitting needle 40. The triangle region 30 is provided here with a pattern which results in a beautiful overall visual appearance.

Figure 9:
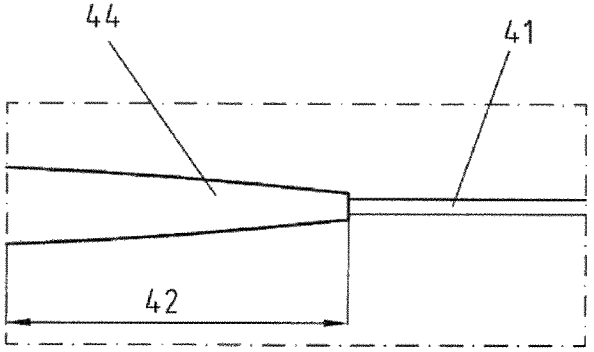
FIG. 9: shows a representation of the end region from FIG. 8, FIG. 10: shows a diagrammatic representation of the course of the cord in the end region of the circular knitting needle from FIGS. 8 and 9, FIG. 11: shows the cord with the circular knitting needle from FIGS. 8 to 10 after the injection molding process with the harder plastic.
Figure 10:
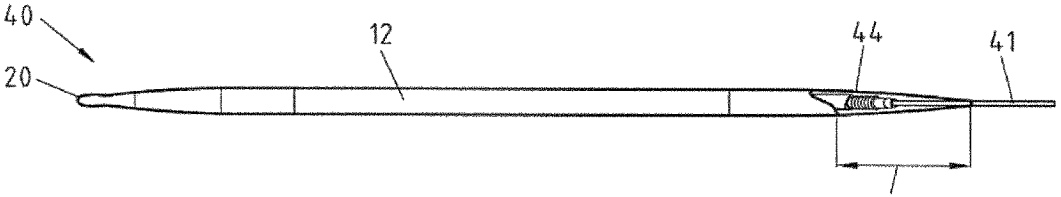
Figure 12:
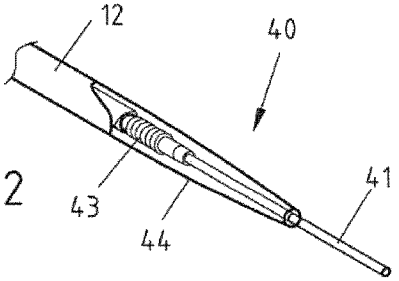
FIG. 12: shows a diagrammatic representation of the coating of a partial region from FIG. 11 with a soft plastic.
Figure 11:
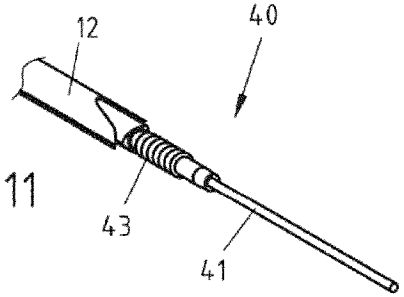

As can also be seen from the enlargement in FIG. 9, the end region 42 is formed with a narrowing and comprises the cord 41. This end region 42 consists of a soft plastic 44, in order to provide a flexible and resilient end region 42, even in the case of greater thicknesses of the circular knitting needle 40. The inner structure of the end region 42 of this circular knitting needle 40 differs from that of the circular knitting needle 40 shown in FIGS. 3 to 7*b*. The shank 12 of the circular knitting needle 40 here too consists of a hard plastic. However, a portion of the end region 42 is made from a soft plastic 44. Here too, during the production process, the cord 41 is overmolded with the material of the end region 42. However, in order to ensure that the soft plastic 44 adheres well to the hard plastic, the hard plastic is produced with an outer contour during the injection process. The fir tree pattern 43 represented here, which can be seen well in FIGS. 11 and 12, is particularly advantageous. In the second production step, that is to say the overmolding with the soft plastic 44, this fir tree pattern 43 is covered. Here, the two plastics can be selected in such a manner that, during the overmolding with the soft plastic 44, the hard plastic melts slightly on the surface and as a result bonds better with the soft plastic 44. Moreover, the soft plastic 44 extends in the direction of the cord 41 beyond the fir tree pattern 43. Due to this fir tree pattern 43, the soft plastic 44 is also additionally retained in position and cannot slip in the direction of the cord 41. In this way, a flexible and resilient end region 42 of the circular knitting needle 40 is formed, which exhibits good flexibility even in the case of large diameters of the circular knitting needle 40.

Figure 13A:
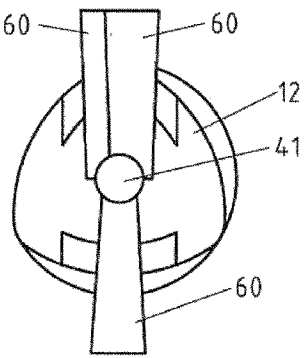
FIG. 13*a*: shows a retention of the cord by retaining cores immediately after the first injection molding process with hard plastic for producing a circular knitting needle according to FIGS. 8 to 12, FIG. 13*b*: shows a circular knitting needle which has been produced and consists of two components according to FIG. 13*a* without retaining cores.
Figure 13B:
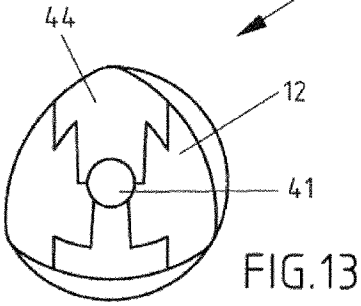

In FIGS. 13*a* and 13*b*, parts of the production process of these circular knitting needles 40 are represented. The cord 41 is again retained in its position via three retaining cores 60 and first overmolded with the hard plastic. Subsequently, the retaining cores 60 are removed, and a second injection molding process with the soft plastic 44 occurs. Thus, the regions in which the retaining cores 60 are in contact with the cord 41 are filled with the soft plastic 44, resulting in a visually uniform overall appearance of the circular knitting needle 40.

Figure 15:
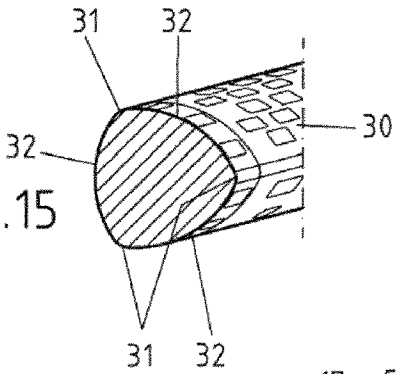
FIG. 15: shows a cross section through the representation of FIG. 14 at the XV-XV site.
Figure 14:
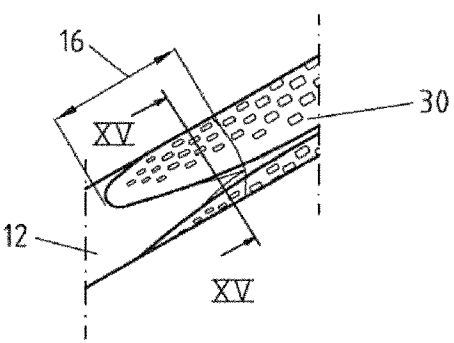
FIG. 14: shows an enlargement of the shape transition to the triangle region.
Figure 16:
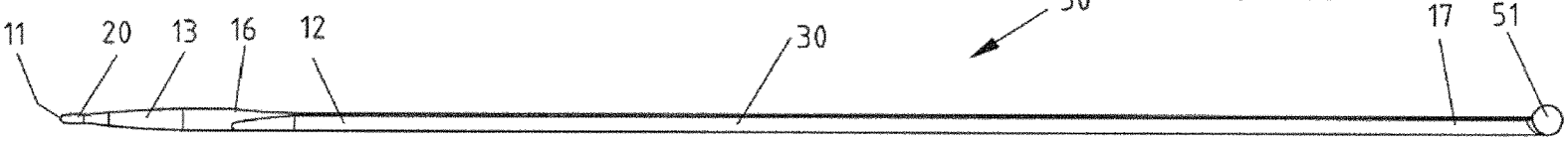
FIG. 16: shows a representation of an inventive cardigan knitting needle.
Figure 19:
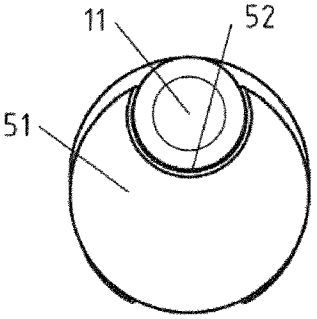
FIG. 19 shows the knitting needle pair from FIG. 18 in a front view.
Figure 18:
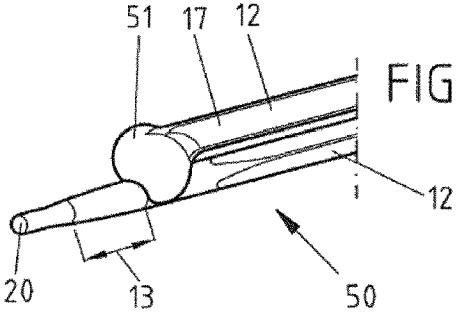
FIG. 18: shows a representation of the clamping of the knitting needle in the recess on the spherical head of the other knitting needle, in a perspective view.
Figure 17:
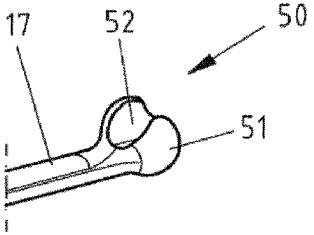
FIG. 17: shows an enlarged representation of the spherical head.

FIGS. 14 and 15 then show the shape transition 16 from the round shank 12 to the triangle region 30. FIG. 15 here shows a cross section through this triangle region 30. From this one can see that the corners 31 of the triangle region 30 are rounded, while the sides 32 are formed convex. As a result, a particularly good shape transition 16 with little frictional resistance is possible, and the knitting slides in the triangle region 30 practically only over the rounded corners 31. As a result, the frictional resistance in the triangle region 30 is lowered further, so that the knitting can slide simply over the length 15 of the knitting needle 10.

FIGS. 16 to 19 show an inventive knitting needle 10 which is designed as a cardigan knitting needle 50. Here too, a retrieval droplet 20 is again provided on the needle tip 11, and a triangle region 30 is provided in the shank 12. On the end 17 of the knitting needle 10, which faces away from the needle tip 11, a spherical head 51 is provided. The spherical head 51 has a groove-shaped recess 52 which has approximately the same width as the shank 12 of the cardigan knitting needle 50. Into this groove-shaped recess 52, the shank 12 of the second cardigan knitting needle 50 can then be introduced in a clamping manner, in order to connect two knitting needles 10 of a pair of cardigan knitting needles 50 to one another. Here, the two cardigan knitting needles 50 can be introduced in a clamping manner with their shank 12 into the groove-shaped recess 52 of the respective other knitting needle 50. The knitting is then located between the two clamping regions of the spherical heads 51 and can thus also not accidentally slide down from the cardigan knitting needle 50. In addition, in this manner, the two cardigan knitting needles 50 of a pair of cardigan knitting needles 50 are always together and the inconvenience of having to look for the second matching cardigan knitting needle 50 is eliminated.

In conclusion, it should be pointed out that the embodiments represented here are only exemplary embodiments of the invention. The invention can be used for all possible types of knitting needles such as cardigan knitting needles, circular knitting needles and sock knitting needles, in a so-called needle set. Here too, the knitting needles can consist of a great variety of materials and be entirely or partially of different colors—for example, also for distinguishing the different thicknesses.

LIST OF REFERENCE NUMERALS

10 Knitting needle
11 Needle tip
12 Shank
13 Gripping region
14 Narrowed portion
15 Length of 10
16 Shape transition
17 End of 10 facing away from 11
20 Retrieval droplet
30 Triangle region
31 Corner of 30
32 Side of 30
40 Circular knitting needle
41 Cord
42 End region
43 Fir tree pattern
50 Cardigan knitting needle
51 Spherical head
52 Groove-shaped recess
60 Retaining core

The invention claimed is:

1. A knitting needle (10) having at least one needle tip (11) and a shank (12), with a gripping region (13) which is arranged on the shank (12) near the needle tip (11) and which has a round cross section, characterized in that the needle tip (11) itself is designed in a rounded manner and transitions into a droplet-shaped or bobble-shaped thickening (retrieval droplet 20) which is rounded towards the tip and which has a smaller diameter than the shank (12), and that the gripping region (13) which is located between shank (12) and needle tip (11) narrows in the direction of the needle tip (11), and that the transition between the shank (12) and a narrowed portion (14) and between the narrowed portion (14) and the retrieval droplet (20) is formed without edges and is smooth.

2. The knitting needle (10) according to claim 1, characterized in that the ratio of the diameter of the retrieval droplet (20) to the diameter of the shank (12) of the knitting needle (10) is dependent on the thickness of the shank (12) of the knitting needle (10) and is 25% to 75%.

3. The knitting needle (10) according to claim 1, characterized in that the shank (12) has a shape transition (16) located behind the gripping region (13) when viewed along its length (15) from the needle tip (11), and there it has a cross section which is approximately in the shape of a triangle (triangle region 30).

4. The knitting needle (10) according to claim 3, characterized in that the triangle area (30) of the shank (12) has rounded corners (31) and convexly shaped sides (32).

5. The knitting needle (10) according to claim 3, characterized in that the shape transition (16) between the circular shank (12) and the triangle region (30) extends smoothly and with little frictional resistance.

6. The knitting needle (10) according to claim 1, characterized in that the shank (12) consists at least regionally of a hard plastic.

7. The knitting needle (10) according to claim 1, characterized in that the knitting needle (10) is formed as a circular knitting needle (40) and becomes smaller behind the gripping region (13) in longitudinal direction (15) of a cord (41).

8. The knitting needle (10) according to claim 1, characterized in that the knitting needle (10) is formed as a circular knitting needle (40), wherein the end region (42) of the shank (12) is designed to be flexible and pliable at the transition to the cord (41).

9. The knitting needle (10) according to claim 8, wherein the shank (12), in its end region (42), consists of a soft plastic at the transition to the cord (41).

10. The knitting needle (10) according to claim 1, characterized in that the knitting needle (10) is designed as a cardigan knitting needle (50) and, at its end (17) facing away from the needle tip (11), it comprises a spherical head (51).

11. The knitting needle (10) according to claim 10, characterized in that the spherical head (51) has a groove-shaped recess (52) which has approximately the same diameter as the shank (12) or the gripping region (13) of the knitting needle (10) and into which the second knitting needle (10) fits in a clamping manner with its shank (12) or its gripping region (13).

12. A method for producing a knitting needle (10), the knitting needle (10) having at least one needle tip (11) and a shank (12), with a gripping region (13) which is arranged on the shank (12) near the needle tip (11) and which has a round cross section, characterized in that the needle tip (11) itself is designed in a rounded manner and transitions into a droplet-shaped or bobble-shaped thickening (retrieval droplet 20) which is rounded towards the tip and which has a smaller diameter than the shank (12), and that the gripping region (13) which is located between shank (12) and needle tip (11) narrows in the direction of the needle tip (11), and that the transition between the shank (12) and a narrowed portion (14) and between the narrowed portion (14) and the retrieval droplet (20) is formed without edges and is smooth, characterized in that the knitting needle (10) is formed as a circular knitting needle (40) and becomes smaller behind the gripping region (13) in longitudinal direction (15) of a cord (41), wherein, in the production of the circular knitting needle (40), a cord (41) is overmolded with the material of the shank (12).

13. The method according to claim 12, characterized in that the cord (41) is first overmolded regionally with a harder plastic of the shank (12) and then with a soft plastic.

14. The method according to claim 13, characterized in that, during the overmolding of the cord (41) made of the harder material, an outer contour is formed.

15. The method according to claim 12, characterized in that the cord (41) is retained during the injection process by one or more retaining cores (60).

16. The knitting needle (10) according to claim 2, characterized in that the ratio of the diameter of the retrieval droplet (20) to the diameter of the shank (12) of the knitting needle (10) is 30% to 60%.

17. The knitting needle (10) according to claim 8, wherein the shank (12), in its end region (42), consists of a flexible plastic at the transition to the cord (41).

18. The knitting needle (10) according to claim 8, wherein the shank (12), in its end region (42), consists of a soft and flexible plastic at the transition to the cord (41).

19. The method according to claim 14, characterized in that the outer contour is a fir tree pattern (43).

* * * * *